US009516986B1

(12) United States Patent
Williams et al.

(10) Patent No.: US 9,516,986 B1
(45) Date of Patent: Dec. 13, 2016

(54) FLASH STEAM GENERATOR

(71) Applicants: Jennifer Beth Williams, Los Angeles, CA (US); Craig Raynold Duda, Los Angeles, CA (US)

(72) Inventors: Jennifer Beth Williams, Los Angeles, CA (US); Craig Raynold Duda, Los Angeles, CA (US)

( * ) Notice: Subject to any disclaimer, the term of this patent is extended or adjusted under 35 U.S.C. 154(b) by 0 days.

(21) Appl. No.: 14/577,215

(22) Filed: Dec. 19, 2014

Related U.S. Application Data

(63) Continuation-in-part of application No. 13/736,040, filed on Mar. 18, 2013, now abandoned.

(51) Int. Cl.
*B08B 3/02* (2006.01)
*A47L 11/40* (2006.01)
*A47L 7/00* (2006.01)

(52) U.S. Cl.
CPC ..... *A47L 11/4086* (2013.01); *A47L 7/0004* (2013.01)

(58) Field of Classification Search
CPC ..... A47L 11/4086
See application file for complete search history.

(56) References Cited

U.S. PATENT DOCUMENTS

| | | | | |
|---|---|---|---|---|
| 2,200,265 | A * | 5/1940 | Ehrgott | 392/398 |
| 2,252,541 | A * | 8/1941 | Arnold | F22B 1/284 392/398 |
| 2,507,293 | A | 5/1950 | Arant | |
| 2,878,360 | A | 3/1959 | McCormack, Jr. | |
| 4,418,724 | A * | 12/1983 | Fricker et al. | 138/149 |
| 6,647,204 | B1 | 11/2003 | Hutchinson | |
| 7,801,424 | B2 | 9/2010 | Cheung | |
| 2012/0282153 | A1 * | 11/2012 | Cheong et al. | 422/292 |

FOREIGN PATENT DOCUMENTS

| | | | |
|---|---|---|---|
| CN | 201010128551 | A * | 10/2010 |
| EP | 1914011 | A2 * | 4/2008 |

* cited by examiner

*Primary Examiner* — Michael Barr
*Assistant Examiner* — Jason Riggleman

(57) ABSTRACT

A steam generator for use within a portable steam generating system. The steam generator is composed of a heater coil looped around an inner casing in a helical pattern with a continuous gap left between successive loops. An outer casing encloses the inner casing and heater coil, creating a channel for fluid flow in the gap between successive loops of the heater coil and the inner and outer casings. An opening allows fluid to be pumped in one end of the channel and heated as it travels along the channel. The fluid is superheated by the heater coil loops and is converted into steam and expands upon depressurization after exiting the steam nozzle. This steam generator can be disposed within a handheld housing within a steam generating system.

2 Claims, 4 Drawing Sheets

28

34
36
38

36
38
36
40
28
40
30
42
32
30
32

FLASH STEAM GENERATOR

CROSS-REFERENCE TO RELATED APPLICATIONS

This application claims priority to, and the benefit of the earlier filing date of: US patent application entitled Optimally compact ergonomic hand-held combination flash heated steam cleaning generator/wet & dry vacuum cleaner and container design, filed on Mar. 18, 2013, Ser. No. 13/736,040, pursuant to 35 USC 120, the contents of which are incorporated herein by reference in its entirety.

BACKGROUND

Field of the Invention

CPC fields: L2501/14, B37/60, B27/00

The disclosure relates to the field of flash steam generators for use within portable steam cleaning devices for both domestic and commercial use.

Description of the Prior Art

Portable steam cleaning devices are used for cleaning a variety of surfaces including floors, countertops, stovetops, tiles, glass, ceramic, clothing and upholstery. The application of high temperature steam can provide the requisite energy and solvent to solubilize greases, stains, dirt, odors, and other difficult to remove contaminants, which can then be removed by wiping or vacuuming. Steam cleaning devices may even be used to remove paint and wallpaper. Furthermore, the steam cleaner can effectively sanitize surfaces by killing dust mites, bacteria, and other pests without the need for chemicals, which makes it an ideal cleaning device for hypoallergenic environments.

While steam cleaners have been used for cleaning purposes for decades, portable steam cleaners have been relatively limited in functionality. There are two types of steam generators used in hand-held steam cleaners: 1 boiler chambers with a heating element to convert a reservoir of water to steam within the boiler, and 2 flash-steam generators that typically utilize a non-ferrous metal sandwich or heating block with internal paths to transport water as it is converted into steam by a heating element cast in the center plate.

Boilers have many disadvantages. They have a long start-up time due to the significant energy needed to heat up a large volume of water in the boiler chamber. Boilers are also heavy and space consuming. Because of its heavy and bulky nature, a boiler is located in a housing sitting on the ground instead of in the hand-held nozzle that is used to dispense steam. Finally, the steam generated in the boiler experiences a loss of heat energy as it travels from the boiler through the hose and out the nozzle, resulting in reduced cleaning capacity.

Flash steam generators are able to generate steam more quickly than boilers because they heat a small volume of water as it flows through paths that wrap around the outside of a heating block or through internal paths located within the heating block. This design allows flash steam generators to be smaller than boilers, which makes them amenable to being disposed in the hand-held nozzle for steam generation immediately before steam is dispensed. Thus, flash steam generators lose comparatively less steam heat and pressure than boilers. However, the current portable flash steam generators still produce relatively weak steam due to the lack of sufficient heat transfer. This limitation can be attributed to a combination of: 1 the low ratio of surface area contact between the water and the heating block relative to the flow volume, and 2 a water flow path that is too short to sufficiently heat the water.

BRIEF SUMMARY

The illustrated embodiments of the invention are directed to a flash steam generator designed to function within a portable steam or steam/vacuum cleaner. The illustrated embodiment addresses the described deficiencies in the current field of small portable steam cleaning units by providing 1 a powerful source of steam with 2 rapid startup time of less than ten seconds and 3 is compact enough to be housed within hand-held devices. The illustrated embodiment achieves these objectives by 1 using a heater coil to directly heat the water or cleaning solution instead of heating a metal block that then heats the water or cleaning solution (or more generally referenced as "fluid"), and 2 increasing the surface area contact between the water or cleaning solution and the heating element heater coil. The illustrated embodiment utilizes the heater coil itself to form at least part of the surface of a defined flow path such that at least 50% of the surface area of the water or cleaning solution flowing through this path is in contact with the outer surface of the heater coil which may include, but is not limited to, an outer surface covering or housing, an insulating coating, or both. A defined flow path is a channel created by the space between loops of the heater coil, wherein the majority of the liquid flow volume follows the path of the channel. More than one heater coil may be used to create this defined flow path. Additional surfaces, walls, or barriers are used to complete the defined flow path by surrounding or sandwiching the heater coils between them. The defined flow path follows a route that increases its length within a given volume as defined by the housing and may be a spiral or helical path, a zig-zag, or some other convoluted path. In a preferred embodiment, the flash steam generator comprises an inner casing, an outer casing, and a heater coil. The heater coil is wrapped around the outside surface of the inner casing in a helical pattern with open space left between successive loops of the heater coil. An outer casing encloses the inner casing and heater coil such that the heater coil is not exposed to the surrounding environment, except through openings that allow the inflow and outflow of liquids and gases. This configuration effectively creates a channel between the inner and outer casings that follows the path created by the gap between the successive loops of the heater coil. Water or cleaning solution is efficiently converted into steam or superheated water as it is pumped through the channel between heater coil loops and receives heat transferred from the heater coil. Efficient steam generation is promoted by two means. First, because the water or cleaning solution travels through the channel between two adjacent heater coil loops, it is being heated from both sides of the channel. This results in a high ratio of surface area in contact with the heater coil relative to the volume of water or cleaning solution, which promotes heat transfer. Second, the helical path of the water or cleaning solution channel increases the length the water or cleaning solution has to travel while in contact with the heater coil, which further promotes heat transfer.

In a preferred embodiment, the inner casing is characterized by a length with a central axis, wherein the heater coil wraps around the inner casing in a helical pattern upwards along the central axis. The outer casing is characterized by a length and volume that are sufficient to accommodate the heater coil loops that are wrapped around the inner casing.

In a preferred embodiment, the space between the inner casing and the outer casing above and below the heater coil loops is sealed to prevent the loss of water, cleaning solution, or steam.

In a preferred embodiment, the inner and outer casings have cross sections perpendicular to their central axis that are geometric in shape. In an alternative embodiment, the inner and outer casings have cross-sectional shapes that are non-geometric shapes. Non-geometric shapes are shapes with irregular contours. An example of an inner or outer casing with a non-geometric cross-section is a cylinder with a groove or indentation that travels upwards in a helix pattern along its length. In an alternative embodiment, the inner and outer casings have a combination of geometric and non-geometric cross sections along their central axis In a preferred embodiment, the heater coil is loosely disposed within the space between the inner and outer casings, This allows room for the expansion of the heater coil once it heats up. Alternatively, the heater coil is tightly sandwiched within the space between the inner and outer casings after expansion from heating.

In a preferred embodiment, the heater coil wraps around the inner casing in at least two complete loops, or more preferably three loops, or more preferably four loops, or more preferably five loops, or more preferably six loops, or more preferably seven loops, or more preferably eight loops, or more preferably nine loops, or more preferably ten loops, or more preferably eleven to fifteen loops, or more preferably sixteen to twenty loops, or more preferably twenty-one to thirty loops, or more preferably over thirty loops.

In a preferred embodiment, the inner and outer casings are hollow along their central axis. The hollow space can be used for storage of other components. Alternatively, a vacuum suction can be applied through the space. This configuration makes use of space within the inner and outer casings to add the vacuum functionality without expanding the size of the housing or adding a vacuum channel external to the outer casing. Thus, the illustrated embodiment maintains a compact size for use within the hand-held component of steam/vacuum combination cleaners.

In a preferred embodiment, the heater coil comprises a resistive nichrome wire enclosed in a layer of electric insulating material.

In a preferred embodiment, the insulated nichrome wire in the heater coil is enclosed in an outer sheath that makes contact with the water or cleaning solution that is heated.

In a preferred embodiment, the nichrome wire is disposed within the entire length of the heater coil and loops around at one end to travel back to the other end of the heater coil where it entered. Having the nichrome wire enter and exit the heater coil on the same end allows the nichrome wire to be connected to an electrical circuit using just one end instead of requiring a connection on both ends.

In a preferred embodiment, the sheath is composed of a metal alloy suitable for conducting heat. The metal alloy can include conventional alloys such as stainless steel, or high performance alloys superalloys with high corrosion resistance, such as Hastelloy®.

In a preferred embodiment, the sheath is encased in a corrosion resistant coating.

In some embodiments, the inner and outer casings are constructed out of metal, alloys, plastic, ceramic, polymers, or composite materials.

In a preferred embodiment, the inner closed casing and the outer closed casing are covered in a corrosion resistant coating.

In a preferred embodiment, the corrosion resistant coating is selected from Teflon®, zinc galvanization, cadmium, plating, enamel, a silicon-based coating such as Silcolloy 1000®, titanium oxide, aluminum oxide, and platinum.

In a preferred embodiment, the steam generator is connected to additional components as part of a steam cleaner apparatus. These other components are standard parts used in steam and vacuum cleaners, and may include but are not limited to the following: a water or cleaning solution storage tank, a wastewater container or waste collecting tank, a water or cleaning solution pump that pumps the water or cleaning solution from the storage tank to the steam generator, tubes through which water or cleaning solution is pumped from the storage tank to the steam generator, a power supply or adapter for the pump, heater coil, and optionally, the vacuum motor, an inlet that funnels water or cleaning solution into the steam generator channel, and an outlet that funnels the superheated water or cleaning solution to a nozzle, which then dispenses the superheated water or cleaning solution that converts to steam as it depressurizes upon exiting the nozzle.

In a preferred embodiment, the steam generator is placed in a housing that constitutes the hand-held portion of the steam cleaner, and components that are too large to fit within the handheld housing are disposed within a larger housing, which is connected to the handheld housing through one or more tubes.

In a preferred embodiment, a thermal insulation material is disposed around the outer casing.

In some embodiments, the thermal insulation material is selected from Aerogel and silica.

In a preferred embodiment, the larger, non-handheld housing has a hinged lid that is detachable. The lid opens to reveal an internal compartment that can store the entire handheld housing.

In a preferred embodiment, the steam nozzle can be connected to attachments that change the shape of the steam as it exits the nozzle.

In a preferred embodiment, an attachment is a flexible hose that allows steam to be aimed around corners and under furniture such as couches and beds and in and around toilets, faucets, and stoves.

In a preferred embodiment, an attachment is a short and rigid wand.

In a preferred embodiment, an attachment is a long and rigid wand.

In a preferred embodiment, the steam nozzle has an attachment with a wide funnel shape (like the head of a broom), wherein the width exceeds the height by at least two-fold. This funnel shaped opening directs a wide but relatively shallow swath of steam towards the surface to be cleaned. While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
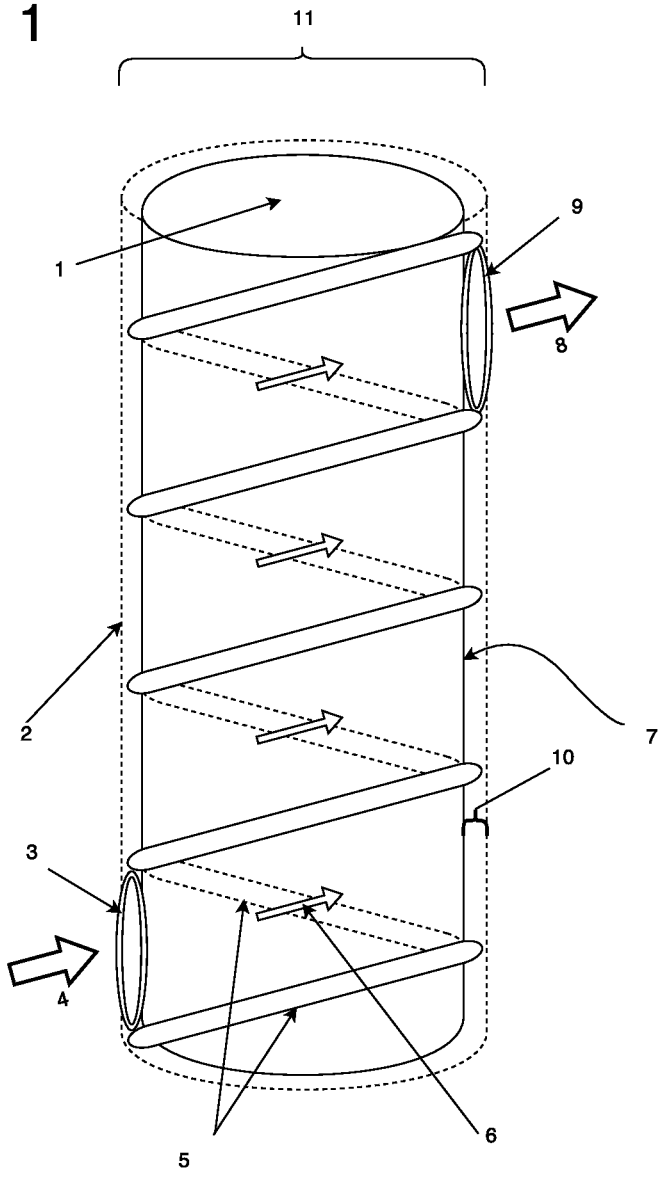
FIG. 1 is a diagram of a steam generator according to the invention.

FIG. 1 illustrates a preferred embodiment of the steam generator 11 that comprises an inner casing 7 and an outer casing 2 with a heater coil 5 interposed in the space between the inner and outer casings 10, wherein the casings are cylindrical in shape. The heater coil 5 is wrapped around the inner casing 7 in successive loops, resulting in a helical pattern that extends up the length of the inner casing 7. The distance separating the surfaces of the inner and outer casings 7, 2 is such that the heater coil 5 loops are disposed within the space between the casings. The space created between the heater coil 5 loops and the surfaces of the inner and outer casings 7, 2 forms a continuous channel 6 that follows the helical route of the heater coil 5 loops. An inlet 3 provides an opening for the inflow of water or cleaning solution 4 pumped into the channel 6 created by the successive loops of the heater coil 5. The water or cleaning solution pumped up the channel 6 in-between the heater coil loops is heated into superheated pressurized water or cleaning solution before exiting the steam generator 11 through the outlet 9. After exiting the outlet 9, the superheated water or cleaning solution converts or flashes into steam 8 upon depressurization, which typically occurs when released from a steam-dispensing nozzle 20.

Figure 3:
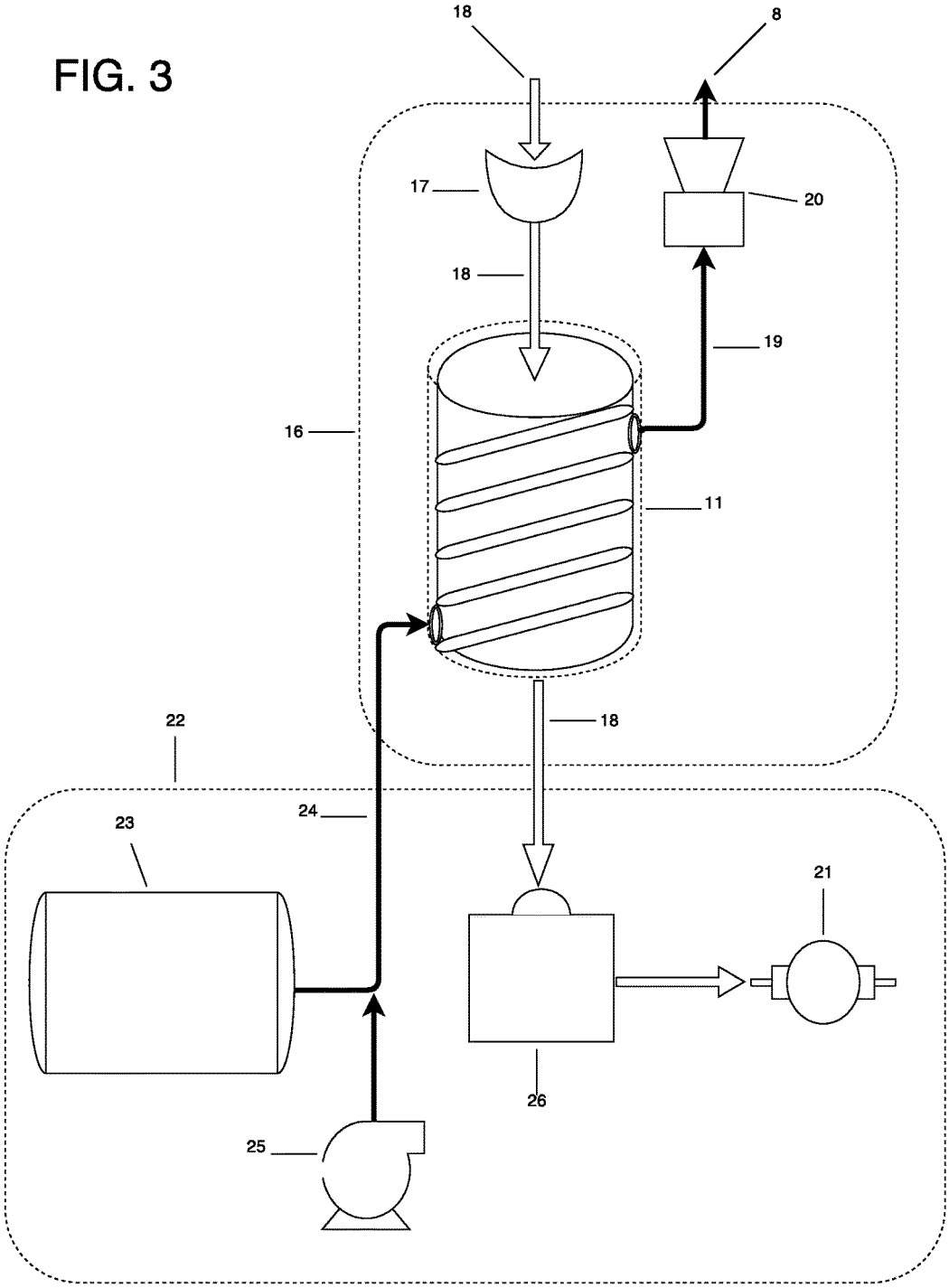
FIG. 3 is a diagram of a steam generating system that incorporates the steam generator of FIG. 1.

In a preferred embodiment, the inner casing 7 has a hollow interior 1, providing a passageway for suction to be applied as part of a steam cleaner/vacuum cleaner combo device shown diagrammatically in FIG. 3. Alternatively, this hollow interior 1 may be used to store steam cleaner components.

Figure 2:
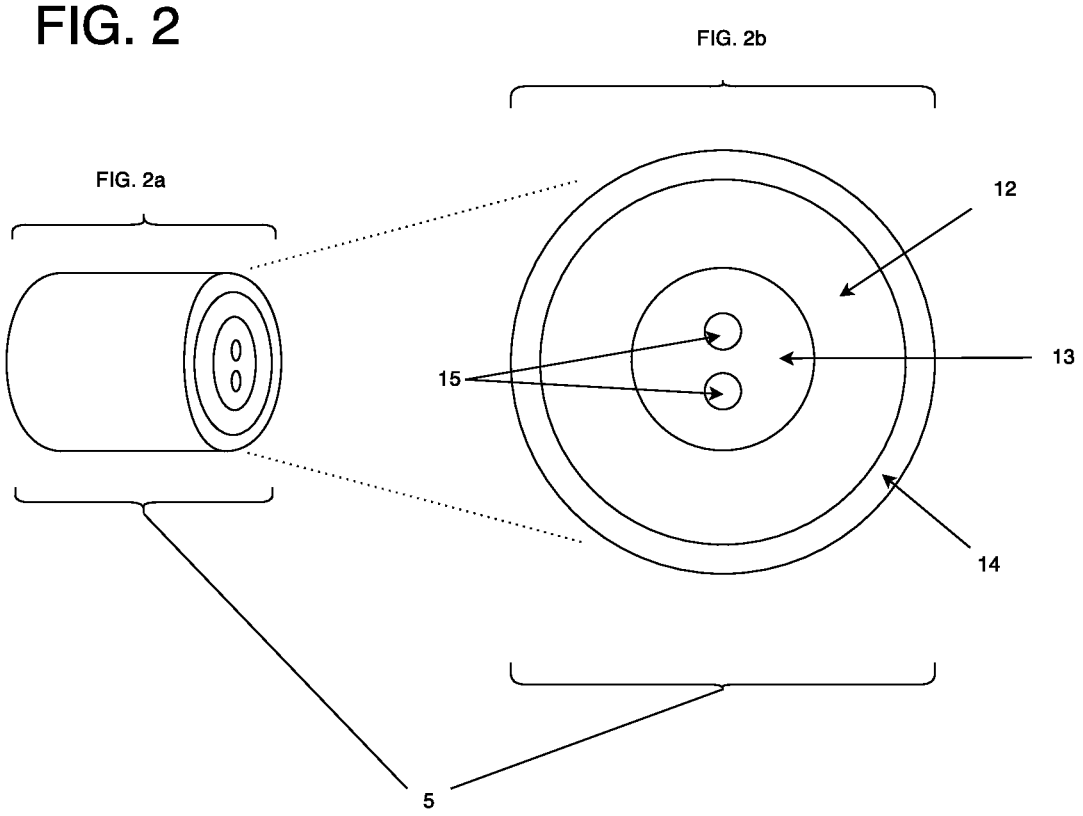
FIG. 2*a* is a perspective view of the heater coil of FIG. 1.
FIG. 2*b* is a diagram showing a perpendicular cross sectional view of the heater coil of FIG. 1.

FIGS. 2*a* and 2*b* illustrate a preferred embodiment of the heater coil 5 used in the steam generator 11 from FIG. 1. A perspective view of the partial side profile in FIG. 2*a* is expanded to present a perpendicular cross-sectional view in FIG. 2*b* of the heater coil comprising an innermost nichrome wire 15 surrounded by a layer of electrical insulating material 13, an outer sheath 12, and an outer corrosion-resistant coating 14. The nichrome wire 15 travels the length of the heater coil 5 and loops around at one end to travel back to the other end.

FIG. 3 is a diagram illustrating a preferred embodiment of a steam cleaning system 16, 22 of FIG. 1 disposed within a handheld housing 16. A non-handheld housing 22 contains a water or cleaning solution pump 25 that pumps water or other cleaning solution from a tank 23 disposed within the non-handheld housing 22 through tubing or a passageway 24 into the steam generator 11. The water or cleaning solution is heated as it travels through the steam generator 11, exits the outlet 9 as superheated water or steam 8, and then travels to a steam-dispensing nozzle 20 where any superheated water converts and flashes into steam 8 upon depressurization.

FIG. 3 also illustrates a preferred embodiment of a steam cleaning system 16, 22 wherein the inner casing 7 of the steam generator 11 is hollow. A vacuum pump 21 supplies suction that draws in air, water, cleaning solution, any dust, dirt and/or debris 18 through a vacuum suction head or vacuum nozzle 17. The air, water, cleaning solution, any dust, dirt and/or debris 18 travel through the hollow space of the inner casing 1 in the steam generator 11 and into a wastewater container or waste collecting tank 26 that filters out any water, cleaning solution, dust, dirt and/or debris from reaching the vacuum pump 21 like a conventional wet/dry vacuum.

Figures 4, 5, 6:
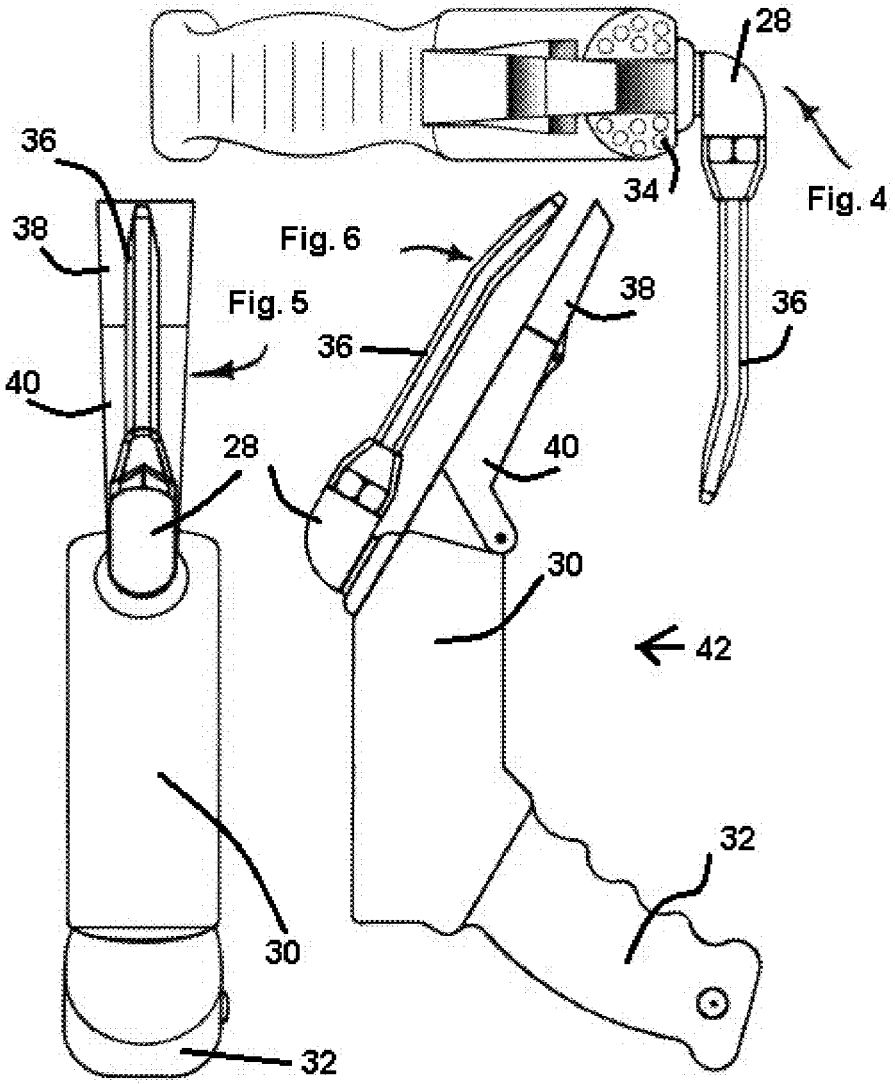
FIG. 4 is a bottom elevational view of the steam cleaner shown with the wand and steam nozzle laterally rotated on the swivel to the side and the vacuum nozzle folded back.
FIG. 5 is a top elevational view of the steam cleaner of FIG. 4 with the vacuum nozzle folded outward in the deployed configuration and the wand and steam nozzle rotated on the swivel to be aligned with the longitudinal axis of the steam cleaner body.
FIG. 6 is a side elevational view of the steam cleaner of FIGS. 4 and 5 shown in the configuration of FIG. 5.

The hand-held steamer 42 of FIGS. 4-6 includes a heat resistant plastic body 30 having a comprised of the handle 32, a flash steamer portion with front mounted steam wand swivel 28 with steam wand 36, and double fold-back vacuum nozzle 38, 40.

FIG. 4 illustrates a bottom elevational view of steamer 42 with a nozzle swivel 28 swiveled ninety degrees to the left side, showing 12 round LED lights 34, the face of the body 30. Nozzle swivel 28 rotates 90 degrees right and left from forward facing steam wand configuration.

The steamer 42 is provided with: three quarter inch diameter stainless steel wand 36 sheathed in nonheat conducting plastic; two rigid and angled wands 36; one five and one twelve inch long wand 36; and one flexible hose or stainless steel conduit type tube (not shown) eighteen inches long for coupling to wands 36; the nozzles 44 snap on to the front end of the hand held steamer 42 and swivel ninety degrees to the right and to the left to be out of the way when vacuuming.

The features of steamer 42 are a childproof pistol-grip handle 32 that reduces muscle fatigue and joint wear, three small diameter point or fan steam nozzle wands 36, long, short and bendable, which can fit into tight spaces, that snap into the front of the pistol-grip steam nozzle cylinder, and the front and center of the vacuum nozzle on the steamer cylinder has a double folding vacuum cleaner nozzle extension 38, 40 that fits in deep narrow spaces, and won't mar surfaces.

As an option, one detachable c-ring ultraviolet LED lamp 34 (snaps onto the face of the steamer 42). The optional ultraviolet LED lamp 34 is in the shape of a c-ring with UV LED lamps 34 surrounding its forward facing side. This ring snaps onto the front face of the steamer 42. The ultraviolet LED lights 34 on the front face of the steamer 42 kill germs wherever the blue—UV light shines.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the embodiments.

We claim:

1. A steam generator for generating steam from a fluid, comprising an inner casing with a corresponding length;

an outer casing, the outer casing being coaxially disposed about the inner casing and defining a closed space therebetween; and a heater coil which is a generator of heat disposed in the space between the inner and outer casings, wherein the heater coil is wound around the length of the inner casing in successive loops defining a gap between each successive loop of the heater coil, the space between the inner and outer casings being sized to sandwich the heater coil between the inner and outer casings to provide a closed flow path for the fluid in the gap defined by adjacent successive loops of the heater coil in direct contact with the fluid and adjacent portions of the inner and outer casings; and openings defined through the outer casing communicating with the defined flow path to allow inflow of the fluid and the outflow of the steam, through selected ones of the openings; and a hand-held housing, wherein the inner and outer casings and the heater coil are disposed within the housing.

2. The steam generator of claim 1, wherein the inner casing has a hollow interior for vacuum intake.

* * * * *